United States Patent [19]

Gwinn, Jr.

[11] 4,392,413

[45] Jul. 12, 1983

[54] MUZZLE ATTACHMENT FOR A FIREARM BARREL

[75] Inventor: Mack W. Gwinn, Jr., Levant, Me.

[73] Assignee: Firepower, Inc., Hancock, Me.

[21] Appl. No.: 222,148

[22] Filed: Jan. 2, 1981

[51] Int. Cl.[3] ..... F41C 21/18

[52] U.S. Cl. ..... 89/14 C

[58] Field of Search ..... 89/14 C, 14 D; 181/223

[56] References Cited

U.S. PATENT DOCUMENTS

| | | | |
|---|---|---|---|
| 1,259,251 | 3/1918 | Love | 89/14 C |
| 1,605,393 | 11/1926 | Cutts, Jr. | 89/14 C |
| 2,212,684 | 8/1940 | Hughes | 89/14 C |
| 2,453,121 | 11/1948 | Cutts | 89/14 C |

*Primary Examiner*—Stephen C. Bentley

*Attorney, Agent, or Firm*—Schwartz & Weinrieb

[57] ABSTRACT

A muzzle attachment for a firearm which is adapted to be secured to the muzzle end portion of the barrel of the firearm. The muzzle attachment has a rearward portion locatable near the muzzle end portion of the firearm barrel which is configured to trap gases that exit from the muzzle portion of the firearm barrel when the firearm is fired. The muzzle attachment has another portion locatable further from the muzzle end portion of the firearm barrel and forward of the gas trapping portion which is configured to act as both a muzzle brake to reduce recoil of the firearm and as a compensator to reduce upward movement of the muzzle portion of the firearm barrel when the firearm is fired. The muzzle attachment also has provisions for reducing the noise that the shooter senses when he fires the firearm.

1 Claim, 8 Drawing Figures

MUZZLE ATTACHMENT FOR A FIREARM BARREL

BACKGROUND OF THE INVENTION

Firearms, except for smallarms chambered for the relatively low powered .22 caliber rimfire cartridges and the like, have to a varying degree a noticable recoil when the firearm is fired. This recoil can have an adverse effect upon the accuracy that the shooter can obtain with the firearm or weapon. This effect is even more noticable in the case of full automatic firearms or weapons.

In addition to exerting a recoil upon firing that is exerted directly rearwardly and transmitted to the firer's shoulder or the like, the recoil resulting from the firing of most of such firearms or weapons tends to cause the muzzle portion of the barrel of the weapon to rise as it is fired. In the case of a full automatic weapon, this tendency can cause the muzzle of the barrel to continue to rise or climb with each shot which means that in most cases only the first few bullets in a burst of automatic fire actually reach the intended aiming point.

While the foregoing effects have an adverse effect upon the accuracy of the firearm or weapon there are also other factors that can be adverse to the shooter. These include the noise from the blast or propellent gases exiting from the muzzle of the barrel. The noise can, of course, have an adverse effect upon the eardrums of the shooter and effect his ability to fire accurately. Again, this effect is usually more pronounced in the case of a fully automatic weapon.

Mechanisms have been known for some time for reducing or attempting to reduce the recoil of firearms or weapons. These have included a recoil absorbing device located in or on the buttstock of the firearm or devices located on or near the muzzle of the barrel of the firearm which are sometimes referred to as muzzle brakes. In addition, apparatus or devices located at or near the muzzle of the barrel of the firearm have been known to reduce or tend to reduce the tendency of the muzzle of the barrel to climb when the weapon is fired. Some of these devices have been called compensators.

In addition, such devices as silencers to reduce the noise of the firing of a weapon from a weapon have been known for many years. However, conventional silencers are not usable in conjunction with a muzzle brake or compensator.

In spite of the fact that such devices or apparatus have been known for many years, no device exists in the prior art that combines all of such favorable features in a single device or muzzle attachment which is the case with the present invention.

BRIEF DESCRIPTION OF THE INVENTION

This invention relates to muzzle attachments for firearm barrels and more particularly muzzle attachments for a firearm barrel that perform more than one function.

It is an object of the present invention to provide a muzzle attachment for a firearm barrel that performs a plurality of functions.

It is also an object of the present invention to provide a muzzle attachment for a firearm barrel that reduces recoil.

It is also an object of the present invention to provide a muzzle attachment for a firearm barrel that tends to reduce the climb of the muzzle when the firearm is fired.

It is also an object of the present invention to provide a muzzle attachment for a firearm barrel that reduces the noise heard by the person firing the firearm.

It is a further object of the present invention to provide a muzzle attachment for a firearm barrel which is particulatly useful in connection with firearms that are capable of full automatic fire.

The present invention provides a muzzle attachment for a firearm having a barrel with a muzzle end portion in which the muzzle attachment has a portion thereof locatable near the muzzle end portion of the barrel including means for trapping gases exiting from the muzzle end portion of the barrel. The muzzle attachment also has another portion locatable further from the muzzle end portion of the barrel and forward of the portion having the means for trapping gases which includes muzzle brake means for reducing the recoil of the firearm as the firearm is fired.

BRIEF DESCRIPTION OF THE DRAWINGS

The invention will be hereinafter more fully described with respect to the accompanying drawings in which.

DETAILED DESCRIPTION OF THE PREFERRED EMBODIMENT

Figure 2:
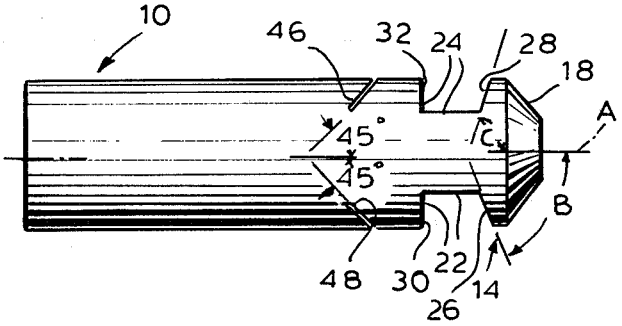
FIG. 2 is a bottom plan view of the muzzle attachment for a firearm barrel set forth in FIG. 1.
Figure 3:
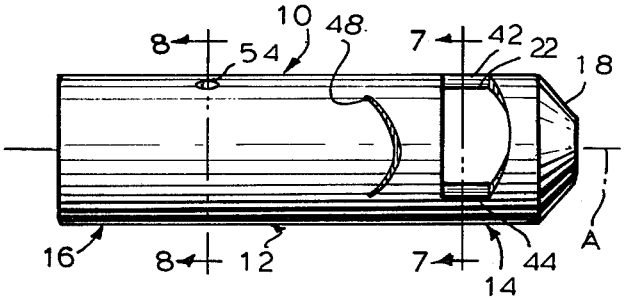
FIG. 3 is a side elevational view of the muzzle attachment for a firearm barrel set forth in FIGS. 1 and 2.
Figure 4:
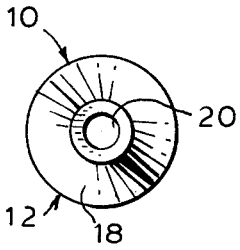
FIG. 4 is an elevational view of the front of the muzzle attachment for a firearm barrel set forth in FIGS. 1 through 3.

As illustrated in FIGS. 1 through 6, the muzzle attachment for a firearm barrel is designated generally by the number 10 and it comprises a generally cylindrical hollow member 12 with a long axis designated by the letter A. The cylindrical member 12 has a forward portion and a rearward portion designated respectively by the numbers 14 and 16. The forward portion 14 has a generally truncated conical shaped end portion 18 which as best illustrated in FIG. 4 has a centralized substantially circular aperture 20 extending from the outside of the forward portion 14 to its interior.

The forward portion 14 has two substantially oppositely located and substantially identical slots or apertures 22 and 24 cut or formed in it so that these slots or apertures extend through the forward portion 14 from its outer to its inner surface. The respective forward surfaces 26 and 28 of the forward portion 14 which form the forward boundaries of the respective apertures 22 and 24 slope forward toward the end portion 18 at substantially the angles B and C (see FIG. 2) with respect to the central axis A of the hollow cylindrical member 12. These angles B and C are substantially equal to 75 degrees.

At the same time the respective rearward surfaces 30 and 32 of the forward portion 14 which form the rearward boundaries of the respective slots or apertures 22 and 24 are in substantially a place that is located substantially perpendicular to or at a ninety degree relationship with the central axis A of the cylindrical member 12. In addition, the other surfaces 34 and 36 and 38 and 40 of the forward portion 14 which form the other boundaries of the respective slots or apertures 22 and 24 are substantially parallel to the central axis A of the hollow member 12.

Figure 7:
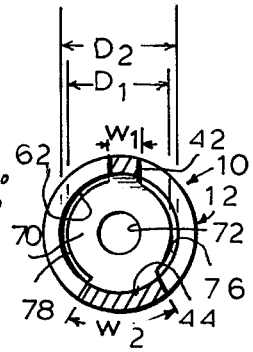
FIG. 7 is a sectional view of the muzzle attachment for a firearm barrel illustrated in FIG. 3 taken substantially on the line 7—7 thereof.

As a result of the slots or apertures 22 and 24 in the forward portion 14, the forward portion has substantially oppositely located respective upper and lower ribs 42 and 44 which are located rearwardly from the conical shaped end portion 18. As best illustrated in FIG. 7, the width $W_1$ of the upper rib 42 is less than the width $W_2$ of the lower rib 44 and in the preferred embodiment $W_1$ is substantially between 25% and 35% of $W_2$. In this connection, when the particular embodiment was tested with an M-16 rifle it was determined that excellent results were obtained with $W_1$ being substantially 30% of $W_2$.

Figure 1:
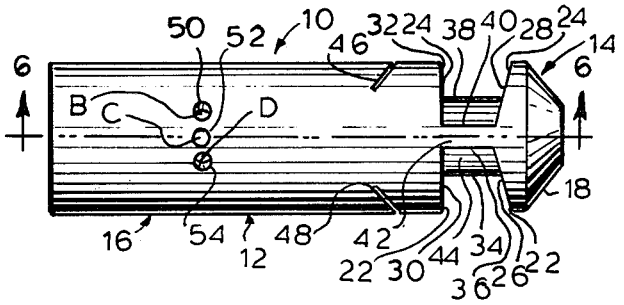
FIG. 1 is a top plan view of the muzzle attachment for a firearm barrel of the present invention.

As best illustrated in FIGS. 1 through 3, two substantially identical slots 46 and 48 are cut or formed in the sides of the forward portion of the rearward portion 16 of the hollow cylindrical member 12. These slots 46 and 48 extend through the walls of the rearward portion 16 from its exterior to its interior. The slots 46 and 48 are located substantially opposite each other and they extend outwardly and forwardly toward the tip portion 18 in such a manner that they each lie in a plane that has substantially a 45 degree angular relationship with the central axis A. As illustrated in FIG. 3 for the slot 48, the slots 46 and 48 form an arc in the sides of the forward portion 14 that are substantially centered on the central axis A of the cylindrical member 12.

Figure 8:
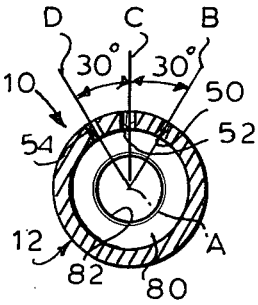
FIG. 8 is a sectional view of the muzzle attachment for a firearm barrel illustrated in FIG. 3 taken substantially on the line 8—8 thereof.

As best illustrated in FIGS. 1 and 8, three substantially identical circular holes are drilled or formed in the upper portion of the rear portion 16 of the hollow cylindrical member 12 and these holes extend through the wall of the rear portion 16 from its exterior to its interior. As illustrated in FIG. 8, these holes 50, 52 and 54 are drilled or formed in the wall of the rear portion 16 in such a manner that the respective long central axes designated respectively by the letters B, C and D substantially pass through the central axis A. The hole 52 is drilled or formed so that its long axis C extends directly upward from the axis A and the holes 50 and 54 are drilled or formed so that they are located on each side of the hole 52 and so that their respective axes B and D are at a 30 degree angular relationship with the axis C of the hole 52. In addition, as best illustrated in FIG. 1 these axes B, C and D line in a plane that is substantially perpendicular to the long axis A of the hollow substantially cylindrical member 12.

Figure 5:
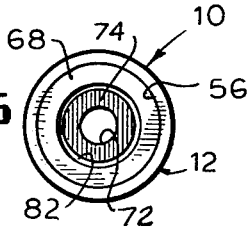
FIG. 5 is an elevational view of the rear of the muzzle attachment for a firearm barrel set forth in FIGS. 1 through 4.
Figure 6:
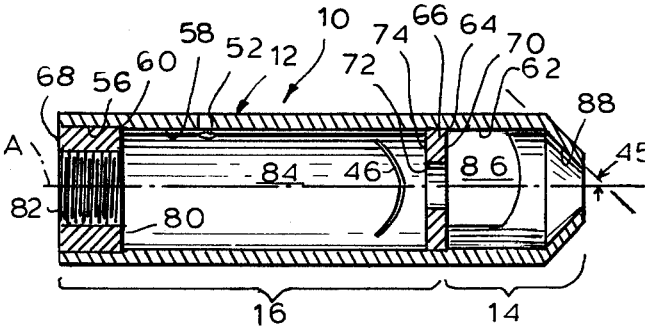
FIG. 6 is a sectional view of the muzzle firearm attachment for a firearm barrel illustrated in FIG. 1 taken substantially on the line 6—6 thereof.

As illustrated in FIGS. 5 and 6, the rear portion 16 of the hollow substantially cylindrical member 14 has a large substantially circular cross section aperture 56. Located immediately adjacent to the aperture 56 is an aperture 58. This aperture 58 also has a substantially circular cross section but the diameter of the aperture 58 is less than the aperture 56 and as a consequence a shoulder 60 is formed between the apertures 56 and 58. Another substantially circular cross section aperture 62 is located immediately forward of the forward portion of the aperture. The diameter of this aperture 62 is less than the diameter of the aperture 58 and as a consequence a shoulder 64 is formed between the apertures 58 and 62.

Two additional components of the muzzle attachment for a firearm 10 in addition to the generally cylindrical hollow member 12 are illustrated in FIGS. 5 through 8 and these comprise two inserts 66 and 68. The insert 66 has a generally circular shaped cross section and is suitably sized so that it can be pressed into place in the aperture 58 so that the outer periphery of a portion of its forward surface 70 fits against the shoulder 64. The insert 66 has a centrally located substantially circular cross section aperture 72 which extends from its forward surface 70 to its rearward surface 74. This aperture 72 is substantially centered on the axis A when the insert 66 has been pressed into place within the aperture 58. A large portion of the outer periphery of the insert 66 has been formed or cut away so that it has a diameter $D_1$ which is less than the diameter $D_2$ of the aperture 62. As a consequence when the insert 66 is pressed into place two oppositely located semicircular slots 76 and 78 are formed as illustrated in FIG. 7. These slots 76 and 78 permit fluid communication between the interior of the aperture 58 and the interior of the aperture 62.

The insert 68 also has a generally circular shaped cross section and is suitably sized so that it can be pressed into place into the aperture 56 so that the outer periphery of its forward surface 80 will be seated against the shoulder 60. The insert 68 has a centrally located threaded circular aperture 82 whose threads are adapted to permit the insert 68 and hence the entire muzzle attachment 10 to be screwed onto the threaded outer end portion of the barrel of a firearm (not shown). The aperture 82 is centrally located about the axis A of the cylindrical member 12.

As best illustrated in FIG. 6, in view of the inserts 66 and 68, the firearm muzzle attachment 10 has a portion thereof locatable near the muzzle end portion of the firearm barrel which includes means for trapping gases exiting from the muzzle end portion of the firearm barrel comprising a confined chamber designated by the number 84 which is located to be in position adjacent to the muzzle of the barrel of the firearm (not shown) to which the muzzle attachment 10 is to be attached. In view of the insert 66 another confined chamber designated by the number 86 is located immediately forward of the rearward chamber 84. The rearward chamber 84 is vented by the circular apertures 50, 52 and 54 through its upper portion, by the slots 46 and 48 extending through its side walls, by the forwardly located semicircular slots 76 and 78 and by the substantially circular aperture 72 which are in fluid communication with the chamber 86. The forward chamber 86 is vented by the slots or apertures 22 and 24, the substantially circular aperture 20 and by the aperture 72. However, when the muzzle attachment 10 is in use the aperture 72 does not serve as a vent since it is receiving gases from the muzzle of the firearm. It should be noted that the interior wall 88 of the forward end portion of the muzzle attachment 10 slopes inwardly toward the aperture 20 substantially at an angle of 45 degrees with respect to the long central axis A of the muzzle attachment 10. It has been determined that the best results are obtained when the volume of the chamber 86 is between substantially one-half to one-third of the volume of the chamber 84. The forward portion 14, which includes the chamber 86, includes muzzle brake means for reducing the recoil of the firearm as the firearm is fired since it has means for interferring with the forward movement of gases exiting from the gas trapping means 84 comprising the tip portion 18 with its sloping inner surface 88.

It should be noted that the semicircular slots 76 and 78 and the circular aperture 72 provide means for causing the means for reducing recoil of the firearm which includes the chamber 86 and the forward tip portion 18 with the sloping inner surface 88 to be in fluid communication with the means for trapping gases exiting from the muzzle end portion of the barrel of the firearm which comprises the chamber 84. In addition, the semicircular slots 76 and 78 comprise means for assisting gases exiting from the means for trapping gases 84 to impinge upon the means for interferring with the forward movement of the gases exiting from the means for trapping gases which comprise the sloping surface 88.

The firearm muzzle attachment 10 is utilized and functions in the following manner. The firearm muzzle attachment 10 is secured to the muzzle portion of a firearm barrel (not shown) by means of the threads in the threaded aperture 82 of the insert 68 which are screwed into or caused to engage matching threads on the muzzle portion of the firearm barrel. In order for these threads in the threaded aperture 82 to engage appropriate matching threads on the muzzle portion of the firearm barrel it may be necessary to remove an existing firearm barrel muzzle attachment in some cases to cut matching threads on the muzzle portion of the barrel of the firearm.

When placing the muzzle attachment 10 on the muzzle portion of the firearm barrel it is important to secure the muzzle attachment 10 in place through the use of a well known lock nut (not shown) or the like so that apertures 50, 52 and 54 face upwardly with respect to the firearm barrel. In particular, the center of the aperture 52 should be located so that it coincides with the uppermost portion of the firearm barrel. This will also mean that the rib 42 is centered on the uppermost portion of the firearm barrel.

After the muzzle attachment 10 is secured in this position on the muzzle portion of the firearm barrel when the firearm is fired gases from the muzzle of the barrel of the firearm exit forward and impinge, at least initially, upon the inner surface 74 of the insert 66 which causes a forward force to be exerted upon the muzzle attachment 10 and hence the entire firearm. These gases upon repeated firing of the firearm will build up and create pressure within the chamber 84. This chamber 84 which is then full of compressed gases then causes a forward force to be exerted upon the muzzle attachment 10 and the entire firearm when gases from the muzzle of the firearm enter the chamber 84.

This chamber 84 is vented at its upper portion by circular shaped cross section apertures 50, 52 and 54 and the gases exiting through these apertures tend to exert a downward force upon the muzzle attachment 10 and hence the forward portion of the firearm barrel and this tends to compensate for the tendency of the muzzle portion of the firearm barrel to rise upon firing. The chamber 84 is also vented by the sideward and forward extending slits or cuts 46 and 48 which primarily serve to reduce the noise from the muzzle gases that is heard by the person firing the firearm in a manner which will be hereinafter more fully explained. The gases from the chamber 84 also pass through the aperture 72 in the insert 66 and through the curved slits 76 and 78 that interconnect the chambers 84 and 86.

It is not completely understood what happens to the gases that enter the chamber 86 through the slits 76 and 78 and the aperture 72. However, it is believed that a portion of these gases impinge upon the inner sloping surface 88 of the end portion 18 and hence exert a forward force upon the muzzle attachment 10 and hence the entire firearm which reduces recoil. A portion of the gases in the chamber 86 also pass through the apertures 22 and 24 in the walls of the forward portion of the muzzle attachment 10 and since the upper rib 42 is substantially narrower in width than the lower rib 44 these gases are directed substantially upwardly and outwardly. As a consequence, a substantial downward force is exerted upon the muzzle attachment 10 and hence the forward portion of the firearm barrel which compensates for the tendency of the muzzle portion of the firearm barrel to rise particularly when the firearm is fired on full automatic. As a consequence, the configuration of the portion of the muzzle attachment locatable further from the muzzle end portion of the firearm barrel comprises means for reducing the tendency of the muzzle end portion of the barrel to rise as the firearm is fired since a portion of the gases exiting from the muzzle end portion of the barrel are diverted substantially in a vertical direction and also to some extend laterally and outwardly in view of the construction of the forward portion 14 of the cylindrical member 12.

As previously indicated, muzzle gases exit forwardly and sidewardly from the slits or cuts 46 and 48 and these exiting gases are substantially in a plane that includes the ears of the person who is firing the firearm which has the muzzle attachment 10 attached to its barrel. Since these gases are exiting in a forward and outward direction, they impinge upon gases exiting in a generally outward direction from the muzzle attachment 10 through the slots 22 and 24 and hence tend to prevent them from expanding or being driven rearwardly which has a noticable sound reducing effect upon the shooter's ears caused by the gases exiting from the muzzle portion of the barrel when the firearm is fired from the normal buttstock to the shoulder position.

In view of the foregoing, it is apparent that the muzzle attachment 10 reduces recoil, compensates for the tendency for the muzzle portion of the firearm barrel to rise upon firing and also reduces the noise heard by the shooter when the firearm is fired in its normal position.

It will be appreciated by those skilled in the art that the size of the muzzle attachment will vary depending upon the size of the firearm and the type of ammunition that is to be used in the firearm.

Although the invention has been described in considerable detail with references to a certain preferred embodiment, it will be understood that variations and modifications may be made within the spirit and scope of the invention as defined in the appended claims.

What is claimed is:

1. A muzzle attachment for a firearm having a barrel with a muzzle end portion, comprising:

a tubular member;

baffle means disposed within said tubular member for defining a first large rearwardly disposed chamber and a second smaller forwardly disposed chamber;

aperture means defined within the upper wall portion of said first large chamber within a rearward region thereof and within the vicinity of the vertical axial plane of said tubular member for venting the gases of said firearm from said first large chamber in a vertically upwardly and outwardly mode as a result of each bore of each aperture intersecting the longitudinal axis of said tubular member whereby a downwardly directed reaction is impressed upon said muzzle attachment and said firearm so as to arrest the natural climb of said firearm and muzzle attachment when said firearm is fired;

the forwardmost end of said tubular member having a substantially truncated conical configuration;

aperture means defined within the central axial and peripheral portions of said baffle means for providing fluidic communication between said first large chamber and said second smaller chamber, the annular portion of said baffle means defined between said central and peripheral aperture means serving as means for interfering with the flow of gases from said first large chamber to said second smaller chamber and thereby provide a reaction surface for said gases whereby a forward force for counteracting the natural recoil of said firearm is impressed upon said firearm and muzzle attachment, said peripheral gas flow from said first chamber to said second chamber impinging upon said truncated surfaces of said forwardmost end of said tubular muzzle attachment whereby said truncated surfaces also serve as reaction means for said gases whereby an additional forward force for counteracting said natural recoil of said firearm is impressed upon said muzzle attachment and said firearm;

rib means defined within the upper and lower wall surfaces of said tubular member defining said second forwardly disposed chamber for defining slot means within the sidewalls of said tubular member attachment such that the net venting effect of said gases from said forward chamber is upwardly and outwardly whereby a net downwardly directed reaction force is impressed upon said muzzle attachment and said firearm so as to arrest the natural climb of said firearm and said muzzle attachment when said firearm is fired; and forwardly and outwardly directed slot means defined within the downstream end of said first larger chamber sidewall portions for venting said gases from said first larger chamber so as to intercept said gases vented from said second smaller chamber through said sidewall slot means and causing all of said gases to flow forwardly away from the muzzle end portion of said firearm barrel and thereby substantially reduce the noise level perceived by the person firing said firearm.

* * * * *